US008418708B2

(12) United States Patent
Benish et al.

(10) Patent No.: US 8,418,708 B2
(45) Date of Patent: Apr. 16, 2013

(54) CANOPY APPARATUS FOR A VEHICLE-MOUNTED WEAPON SYSTEM

(75) Inventors: Bobby Jo Benish, Bedford, IN (US); John Felix Schneider, Huntingburg, IN (US)

(73) Assignee: TS2 Tactical Spec-Solutions Inc., Bedford, IN (US)

( * ) Notice: Subject to any disclaimer, the term of this patent is extended or adjusted under 35 U.S.C. 154(b) by 94 days.

(21) Appl. No.: 13/074,057

(22) Filed: Mar. 29, 2011

(65) Prior Publication Data

US 2011/0271993 A1 Nov. 10, 2011

Related U.S. Application Data

(60) Provisional application No. 61/319,591, filed on Mar. 31, 2010.

(51) Int. Cl.
*E04H 15/06* (2006.01)

(52) U.S. Cl.
USPC ..... 135/88.14; 135/88.07

(58) Field of Classification Search ..... 135/88.14, 135/88.07, 88.16, 88.17; 114/361; 296/100.14, 296/100.17, 100.18, 107.07, 107.11, 107.13, 296/107.18, 107.19, 136.1, 136.11, 136.12, 296/136.13
See application file for complete search history.

(56) References Cited

U.S. PATENT DOCUMENTS

| | | | | |
|---|---|---|---|---|
| 609,553 | A | | 8/1898 | Lloyd |
| 2,598,940 | A | | 6/1952 | Robie |
| 2,798,501 | A | | 7/1957 | Oliver |
| 2,910,078 | A | | 10/1959 | Schunck |
| 3,351,078 | A | * | 11/1967 | Kleiman ..... 135/148 |
| 3,513,861 | A | | 5/1970 | Johnson |
| 3,712,316 | A | | 1/1973 | Leonard |
| 3,848,615 | A | | 11/1974 | Warner et al. |
| 3,894,765 | A | * | 7/1975 | Bourke et al. ..... 135/88.14 |
| 3,906,968 | A | | 9/1975 | Black |
| 3,955,731 | A | * | 5/1976 | Lindelef et al. ..... 224/328 |
| 4,116,206 | A | | 9/1978 | Warner et al. |
| 4,402,544 | A | | 9/1983 | Artim et al. |
| RE31,465 | E | * | 12/1983 | Robichaud ..... 135/133 |
| 4,425,929 | A | | 1/1984 | Von Mosshaim |
| 4,886,083 | A | | 12/1989 | Gamache |
| 4,964,669 | A | * | 10/1990 | Geier ..... 296/108 |
| 5,013,079 | A | | 5/1991 | Ho |
| 5,085,240 | A | | 2/1992 | Littledeer |
| 5,159,947 | A | | 11/1992 | Chuang et al. |
| 5,655,559 | A | | 8/1997 | Zembik et al. |

(Continued)

*Primary Examiner* — Noah Chandler Hawk
(74) *Attorney, Agent, or Firm* — Maginot, Moore & Beck

(57) ABSTRACT

A canopy apparatus includes a first and a second track assembly, a first and a second slide member, a frame apparatus, and a canopy assembly. The first and the second track assembly are configured for connection to the vehicle, the first track assembly defines a longitudinal axis. The first slide member slideably engages the first track assembly and is configured to move relative to the first track assembly in a direction parallel to the longitudinal axis. The second slide member slideably engages the second track assembly and is configured to move relative to the second track assembly in the direction parallel to the longitudinal axis. The frame apparatus includes a bail member having a first end portion configured for pivotal connection to the first slide member and a second end portion configured for pivotal connection to the second slide member. The canopy assembly is configured for connection to the frame apparatus. The frame apparatus is configured for movement in the direction parallel to the longitudinal axis about the first and the second track assemblies.

16 Claims, 7 Drawing Sheets

U.S. PATENT DOCUMENTS

| | | | | |
|---|---|---|---|---|
| 5,746,237 | A | 5/1998 | Arnic | |
| 5,842,495 | A | 12/1998 | Egnew et al. | |
| 6,006,692 | A * | 12/1999 | Szukhent, Jr. | 114/361 |
| 6,035,875 | A * | 3/2000 | Chen | 135/88.07 |
| 6,257,261 | B1 * | 7/2001 | Johnson | 135/96 |
| 6,349,732 | B1 | 2/2002 | Cooper | |
| 7,013,904 | B2 | 3/2006 | Kofler | |
| 7,147,265 | B1 * | 12/2006 | Schmeichel | 296/100.14 |
| 7,311,112 | B2 * | 12/2007 | Pacheco | 135/88.07 |
| 7,604,016 | B2 | 10/2009 | Songest | |
| 7,950,342 | B2 * | 5/2011 | Russikoff | 114/361 |
| 2008/0308138 | A1 * | 12/2008 | Brochier et al. | 135/88.17 |

* cited by examiner

CANOPY APPARATUS FOR A VEHICLE-MOUNTED WEAPON SYSTEM

CROSS-REFERENCE TO RELATED APPLICATION

This application claims priority from U.S. provisional patent application No. 61/319,591, filed Mar. 31, 2010, the contents of which are incorporated herein by reference.

TECHNICAL FIELD

The present disclosure relates to the field of canopy apparatus and more particularly, to canopy apparatus for covering a portion of a vehicle.

BACKGROUND

Military vehicles, such as the High Mobility Multi-Purpose Wheeled vehicle, commonly referred to as the HMMWV or simply as the Humvee, are utilized by military personnel as cargo and troop carriers, ambulances, and as weapon platforms. An exemplary Humvee 20 is shown in FIG. 7. The Humvee 20 is a four wheel drive vehicle capable of traversing roadways, muddy wetlands, snow-covered regions, jungle zones, sandy desserts, and other types of terrain.

The exemplary Humvee 20 includes a roof-mounted weapon system 24, which includes a turret-mounted machine gun 28. A turret gunner operates the machine gun 28, and any other roof mounted equipment, through a turret opening 32 in a roof portion 36 of the vehicle 20. Some embodiments of the turret-mounted machine gun 28 enable the turret gunner to rotate the machine gun 360° relative to the Humvee 20. Additionally, the machine gun 28 may be pivoted about a horizontal axis, thereby giving the turret gunner the ability to aim the machine gun at both ground and air-based targets positioned on any side of the vehicle 20.

Even though the machine gun 28 is removable from the weapon system 24, the machine gun frequently remains in the roof-mounted position for an extended time period, such that the machine gun is ready for use with little advanced notice. Accordingly, the weapon system 24, and any other roof-mounted equipment, are exposed to potentially damaging environmental elements. For example, in a sandy desert environment dust storms are frequent, and have the potential to affect the weapon system 24 and the other roof-mounted equipment. Similarly, rain, snow, and other environment elements may also affect the weapon system 24.

It is known to provide a cover for roof-mounted equipment on a vehicle; however, known cover systems are generally not suitable for military applications and other applications, which require fast access to the roof-mounted equipment. For example, known cover systems are time consuming and cumbersome to attach to the vehicle, often requiring the use of hand tools. Additionally, after being deployed over the roof-mounted equipment, known cover systems are time consuming to retract. Furthermore, known cover systems often require users to modify the vehicle to which the cover system is to be attached, by permanently connecting brackets or other members to the vehicle. These modifications may not be permitted in some applications, such as military applications. Accordingly, further developments in the area of cover systems for roof-mounted equipment are desirable.

SUMMARY

A canopy apparatus configured for connection to a roof portion of a vehicle has been developed. The canopy apparatus includes a first track assembly, a second track assembly, a frame apparatus, and a canopy assembly. The first track assembly includes (i) a first rail member, (ii) a first hook member connected to a first end portion of the first rail member, (iii) a second hook member connected to a second end portion of the first rail member, and (iv) a first slide member configured for movement along the first rail member between the first and the second hook members. The second track assembly includes (i) a second rail member, (ii) a third hook member connected to a third end portion of the second rail member, (iii) a fourth hook member connected to a fourth end portion of the second rail member, and (iv) a second slide member configured for movement along the second rail member between the third and the fourth hook members. The frame apparatus includes (i) a first bail member having a fifth end portion pivotally connected to the first slide member and a sixth end portion pivotally connected to the second slide member, (ii) a second bail member pivotally connected to the first bail member, and (iii) a third bail member pivotally connected to the second bail member. The canopy assembly is configured for connection to at least one of the first, second, and third bail members. The first and the second hook members are configured to connect the first rail member to the roof portion of the vehicle without modifying the roof portion. The third and the fourth hook members are configured to connect the second rail member to the roof portion of the vehicle without modifying the roof portion. The frame apparatus is movable relative to the first and the second track assembly between a deployed position and a retracted position. The canopy assembly covers at least a portion of a roof-mounted assembly connected to the roof portion of the vehicle when the frame apparatus is in the deployed position.

According to another embodiment of the present disclosure, a canopy apparatus for connection to a vehicle has been developed. The canopy apparatus includes a first and a second track assembly, a first and a second slide member, a frame apparatus, and a canopy assembly. The first and the second track assembly are configured for connection to the vehicle, the first track assembly defines a longitudinal axis. The first slide member slideably engages the first track assembly and is configured to move relative to the first track assembly in a direction parallel to the longitudinal axis. The second slide member slideably engages the second track assembly and is configured to move relative to the second track assembly in the direction parallel to the longitudinal axis. The frame apparatus includes a bail member having a first end portion configured for pivotal connection to the first slide member and a second end portion configured for pivotal connection to the second slide member. The canopy assembly is configured for connection to the frame apparatus. The frame apparatus is configured for movement in the direction parallel to the longitudinal axis about the first and the second track assemblies.

According to yet another embodiment of the present disclosure, a canopy apparatus has been developed. The canopy apparatus includes a track assembly, a frame apparatus, and a canopy assembly. The frame apparatus is configured for pivotal connection to the track assembly. The canopy assembly (i) is configured for connection to the frame apparatus, (ii) defines a first aperture and a second aperture, and (iii) includes a closure apparatus configured to connect the first aperture to the second aperture when in an open position and configured to isolate the first aperture from the second aperture when in a closed position. The track assembly is configured for connection to a roof portion of a vehicle.

BRIEF DESCRIPTION OF THE DRAWINGS

Features of the present disclosure should become apparent to those of ordinary skill in the art to which this device pertains from the following description with reference to the figures, in which.

DETAILED DESCRIPTION

For the purpose of promoting an understanding of the principles of the device described herein, reference is made to the embodiments illustrated in the figures and described in the following written specification. It should be understood that no limitation to the scope of the device is thereby intended. It should be further understood that the device includes any alterations and modifications to the illustrated embodiments and includes further applications of the principles of the device as would normally occur to one of ordinary skill in the art to which this device pertains.

Figure 1:
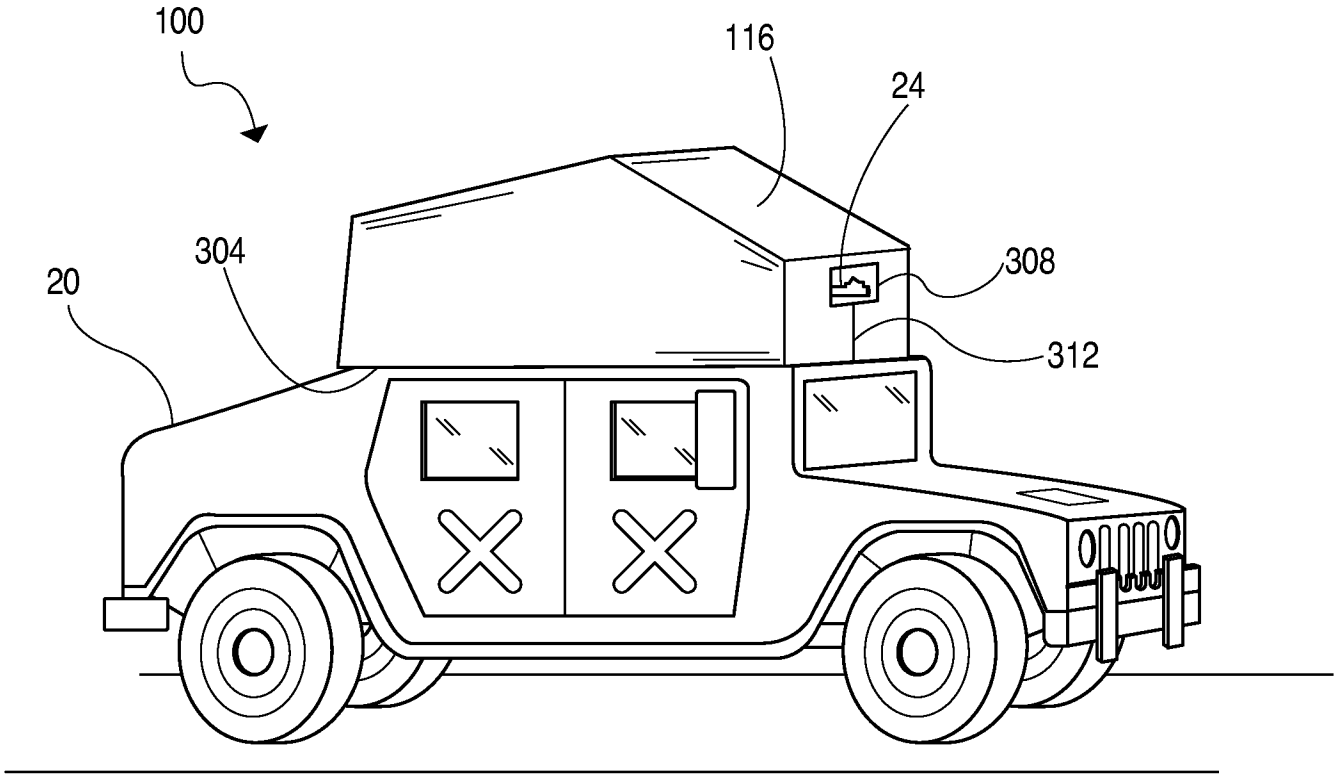
FIG. 1 shows a perspective view of a cover apparatus connected to a vehicle having a roof-mounted weapon system, the cover apparatus being in a deployed position.
Figure 5:
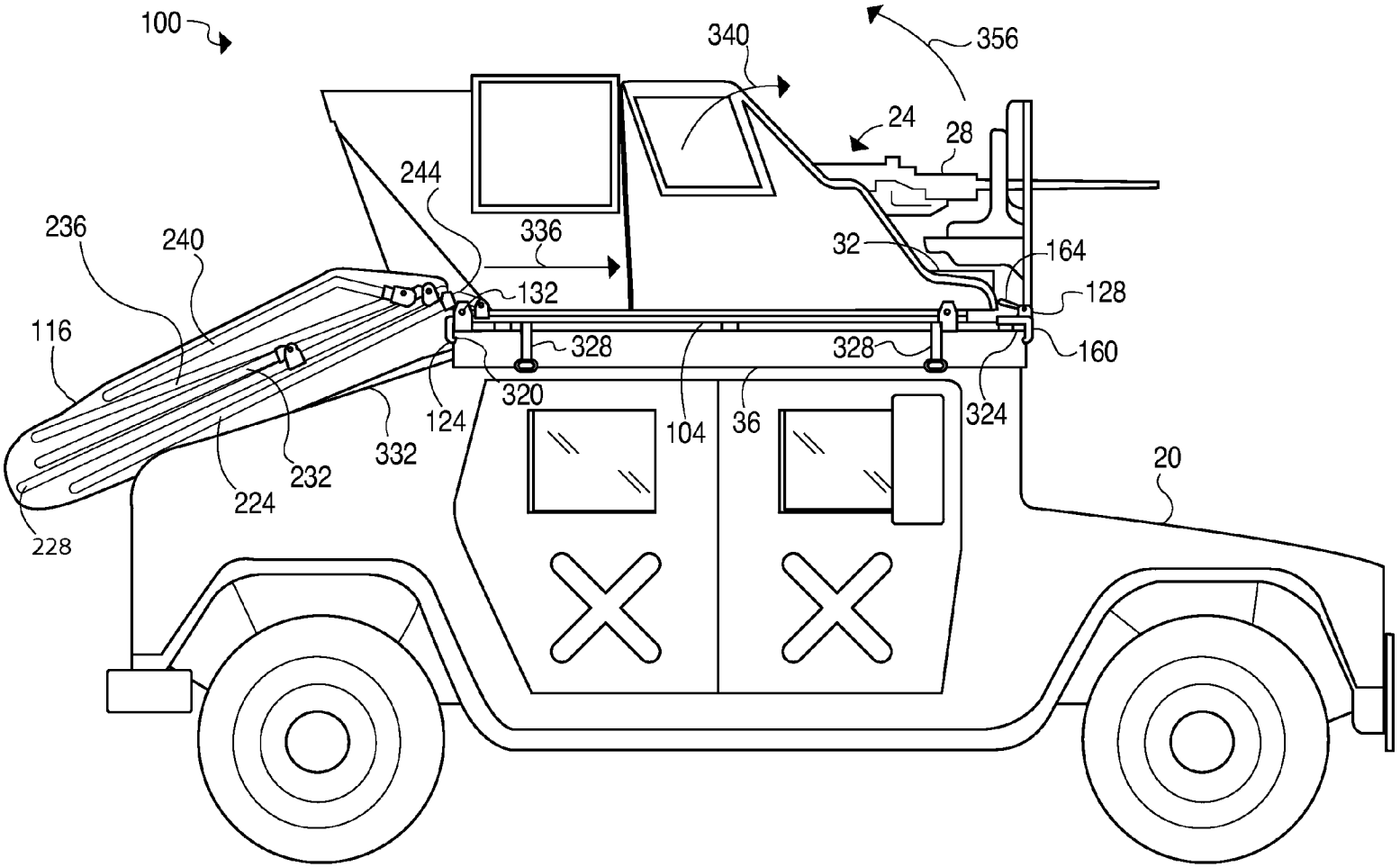
FIG. 5 shows a side elevational view, partially in cross-section, of the cover apparatus of FIG. 1 in a retracted position.

As shown in FIG. 1, a canopy apparatus 100 is connected to a vehicle 20. The canopy apparatus 100 is shown in a deployed position over a roof-mounted weapon system 24 (partially obscured in FIG. 1) of the vehicle 20. The canopy apparatus 100 is quickly and easily securable to any type of vehicle, including the Humvee vehicle 20, to protect roof-mounted equipment from environmental elements. Additionally, the canopy apparatus 100 is quickly and easily retractable (as shown in FIG. 5) to expose the weapon system 24. The components and operation of the canopy apparatus 100 are described in detail below.

Figure 2:
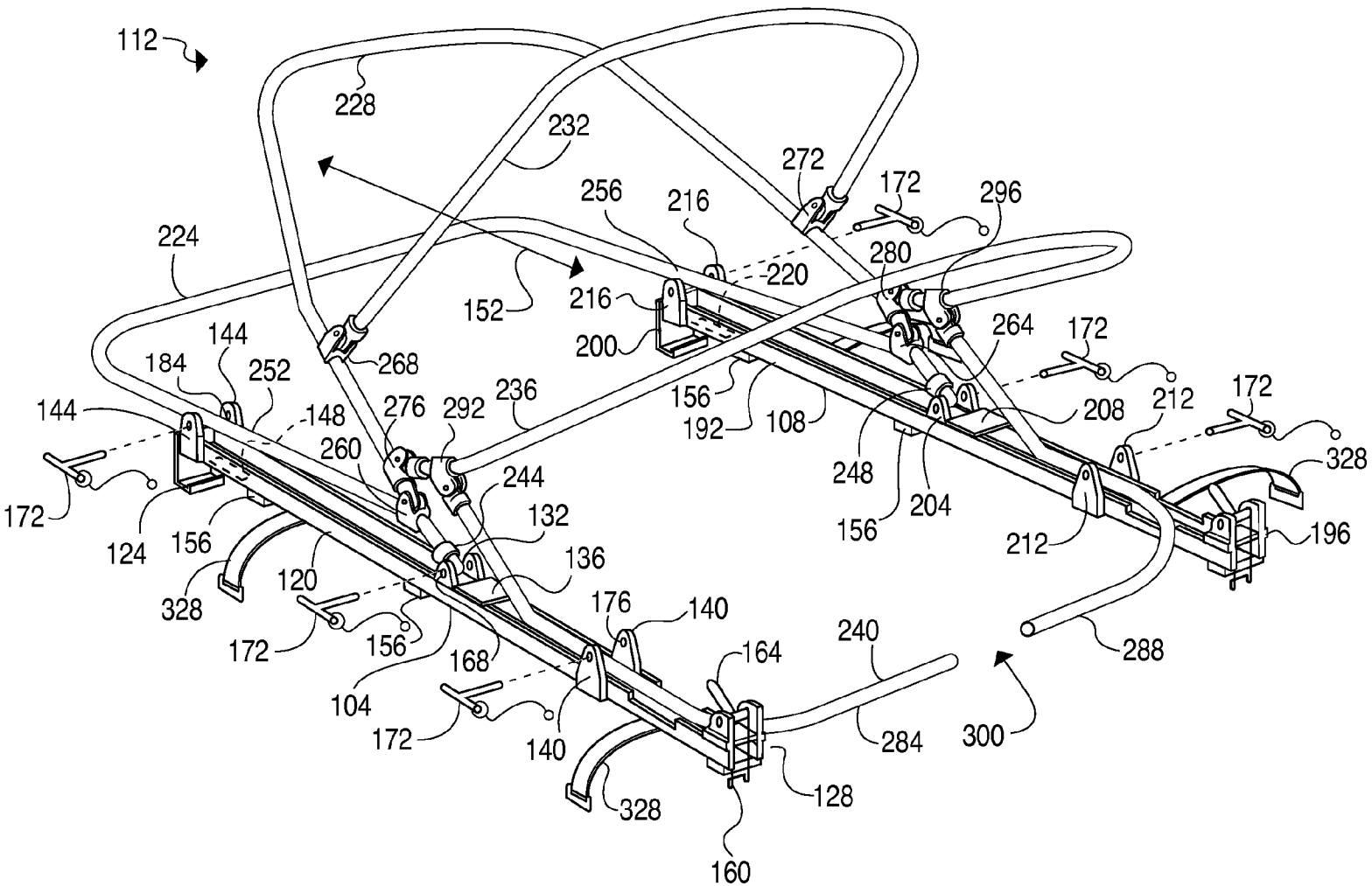
FIG. 2 shows a perspective view of a frame apparatus connected to a rail system of the cover apparatus of FIG. 1.

As shown in FIGS. 2 and 3, the canopy apparatus 100 includes a right track assembly 104, a left track assembly 108, a frame apparatus 112, and a canopy assembly 116. The track assemblies 104, 108 are connectable to the roof portion 36 of the vehicle 20. In the embodiment of FIG. 2, the track assemblies 104, 108 are identical, such that the right track assembly 104 is connectable to the right side or the left side of the roof portion 36, and the left track assembly 108 is connectable to the left side or the right side of the roof portion.

As shown in FIG. 2, the right track assembly 104 includes a rail member 120, a rear hook member 124, a front hook member 128, a slide member 132, a slide stop 136, a pair of front fastening tabs 140, a pair of rear fastening tabs 144, and a debris outlet 148. The rail member 120, in the embodiment of FIG. 2, is a U-shaped rail, which defines a longitudinal channel. The rail member 120 is formed from a rigid material such as steel, iron, or aluminum, among other materials. When the rail member 120 is formed from aluminum, it is lightweight, compared to rail members formed from steel or iron. The rail member 120 defines a longitudinal axis 152, which extends from a front end portion to a rear end portion of the rail member. Elastomeric bumpers 156 may be connected to a bottom side of the rail member 120 to prevent the rail member from scratching, damaging, or otherwise modifying the vehicle 20.

The rear hook member 124 is connected the rear end potion of the rail member 120. The rear hook member 124 may be formed from the same material(s) as the rail member 120. The rear hook member 124 is fixedly connected to the rail member 120, such as by welding, to prevent movement of the rear hook member relative to the rail member. In an alternative embodiment, the rear hook member 124 may be pivotally connected to the rear end portion of the rail member 120. The rear hook member 124 is configured to interface with an opening, ridge, or other existing feature of the vehicle 20.

Figure 3B:
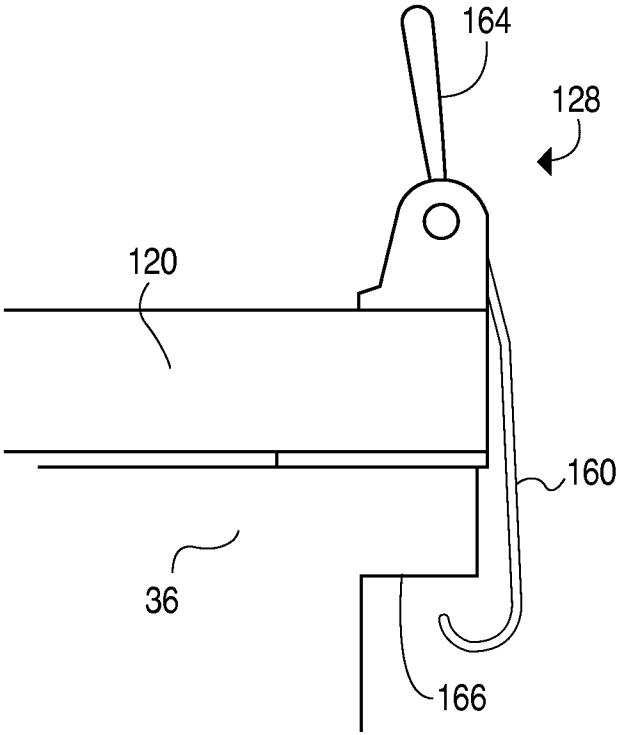
FIG. 3B shows a side elevational view of the portion of the rail system shown in FIG. 3A with the clamp unit in an open position.
Figure 3A:
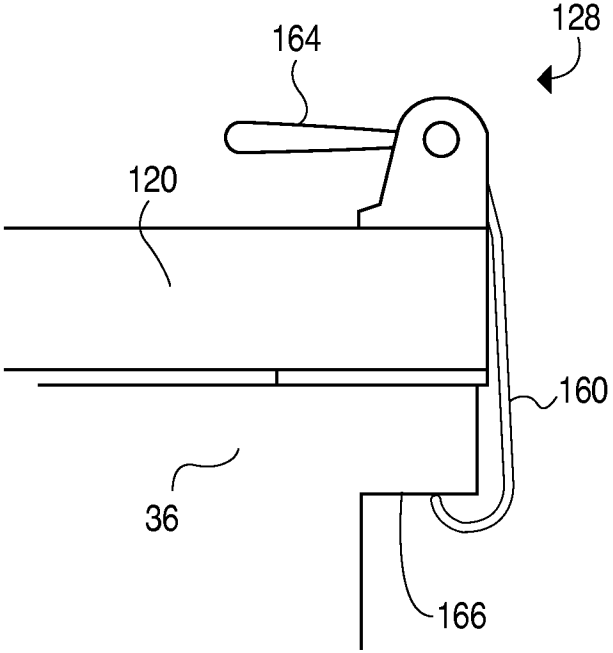
FIG. 3A shows a side elevational view of a portion of the rail system of FIG. 2 with a clamp unit of the rail system in a closed position.

As shown in FIGS. 3A and 3B, the front hook member 128 is connected to the front end portion of the rail member 120. The front hook member 128 includes a roof hook 160 and clamp unit 164. The roof hook 160 is a J-shaped hook configured to interface with existing ridge 166 formed in the vehicle 20. The existing ridge 166 may be an opening, lip, seam, or any other existing feature of the vehicle 20 to which the roof hook 160 may be interfaced. In other embodiments, the roof hook 160 may have a shape other than a J-shape as determined by the characteristics of the vehicle 20 to which the right track assembly 104 is to be connected and the characteristics of the ridge 166. When the ridge 166 is an opening the roof hook 160 extends partially into the opening.

The clamp unit 164 of the front hook member 128 is associated with the roof hook 160 and is movable between a closed position (shown in FIG. 3A) and an open position (shown in FIG. 3B). In the closed position, the clamp unit 164 moves the roof hook 160 to a position which secures the right track assembly 104 in a fixed position relative to the roof portion 36 of the vehicle 20. Specifically, when moved to the closed position the clamp unit 164 pulls the roof hook 160 into tight engagement with the ridge 166. In the open position, the clamp unit 164 moves the roof hook 160 to a position which enables the right track assembly 104 to be moved relative to the roof portion 36, and the roof hook is separable from the ridge 166. The clamp unit 164 may be any clamp assembly configured to position the roof hook 160, in the manner described above.

With reference again to FIG. 2, the slide member 132 is configured for movement along the rail member 120 between the front hook member 128 and the rear hook member 124. The slide member 132 is received by the longitudinal channel of the rail member 120, such that the slide member 132 slides freely in a direction parallel to the longitudinal axis 152. The slide member 132 interlocks with the rail member 120 to prevent the slide member from being separated from the rail member in response to an upwardly directed force applied to the slide member. The slide member 132 defines an opening 168 configured to receive a removable pin 172. The slide member 132 is formed from steel, iron, aluminum, or the like.

The slide stop 136 is fixedly connected to the rail member 120 and limits the distance along the rail member that the slide member 132 is able to slide. Accordingly, the slide member 132, as shown in FIG. 2, slides along the rail member 120 between the rear hook member 124 and the slide stop 136.

The pairs of fastening tabs 140, 144 are connected to the sides of the rail member 120. The front fastening tabs 140 are positioned near the front hook member 128 and define an opening 176 through which a removable pin 172 may be inserted. The rear fastening tabs 144 are positioned near the rear hook members 128 and define an opening 184 through which a removable pin 172 may be inserted.

The debris outlet 148 of the right track assembly 104 is an opening in the rail member 120 positioned near the rear hook member 124. Debris including, sand, dust, plant matter, water, and the like may collect in the channel defined by the rail member 120. The debris outlet 148 enables the debris to exit the channel in the rail member 120. In particular, movement of the slide member 132 toward the debris outlet 148 may guide debris collected in the rail member 120 out the debris outlet. In one embodiment, the debris outlet 148 may define an aperture through which debris such as shell casings and other waste products generated by the weapon system may exit the channel in the rail member 120.

The left track assembly 108 includes a rail member 192, a front hook member 196, a rear hook member 200, a slide member 204, a slide stop 208, a pair of front fastening tabs 212, a pair of rear fastening tabs 216, a debris outlet 220, and other components, which correspond to the components of the right track assembly 104. As previously described, the left track assembly 108 is identical to the right track assembly 104, and the components of left track assembly are positioned, formed, connected, and operate in an identical manner to the components of the right track assembly.

With continued reference to FIG. 2, the frame apparatus 112 is pivotally connectable to the track assemblies 104, 108. The frame apparatus 112 includes a base bail member 224, an intermediate bail member 228, a first upper bail member 232, a second upper bail member 236, and a split bail member 240. The bail members 224, 228, 232, 236, 240 are generally "U" shaped tubular structures, which support the canopy assembly 116 when the canopy apparatus 100 is in the deployed position. The bail members 224, 228, 232, 236, 240 are generally rigid and lightweight and may be formed from materials including, stainless steel, aluminum, fiberglass, plastic, reinforced carbon fiber materials, and the like.

The base bail member 224 is pivotally connected to the slide members 132, 204. To this end, the base bail member 224 includes a right pivot unit 244 connected to a right end portion of the base bail member 224 and a left pivot unit 248 is connected to a left end portion of the base bail member. The pivot units 244, 248 each define an opening (not shown) through which a removable pin 172 may be inserted. In particular, when a removable pin 172 is inserted through the opening(s) 168 in the slide member 132 and the opening(s) in the pivot unit 244, the right end portion of the base bail member 224 is pivotally connected to the right track member 104. The left end portion of the base bail member 224 is pivotally connected to the left track member 108 in a similar manner.

With reference still to FIG. 2, the base bail member 224 further includes a right hold down portion 252 and a left hold down portion 256. When the canopy assembly 116 is in the deployed position, the right hold down portion 252 is positioned between rear fastening tabs 144 and the left hold down portion 256 is positioned between the rear fastening tabs 216. A removable pin 172 may be inserted through the openings 184 to lock the right hold down portion 252 between the rail member 120 and the removable pin, thereby preventing pivoting of the base bail member about the slide members. A removable pin 172 may be received by the fastening tabs 216 to lock the position of the left hold down portion 256 in a similar manner.

The intermediate bail member 228 of the frame apparatus 112 is pivotally connected to the base bail member 224. The intermediate bail member 228 includes a right pivot unit 260 and a left pivot unit 264. The right pivot unit 260 connects a right end portion of the intermediate bail member 228 to the base bail member 224. The left pivot unit 264 connects a left end portion of the intermediate bail member 228 to the base bail member 224.

The first upper bail member 232 of the frame apparatus 112 is pivotally connected to the intermediate bail member 228. The first upper bail member 232 includes a right pivot unit 268 and a left pivot unit 272. The right pivot unit 268 connects a right end portion of the first upper bail member 232 to the intermediate bail member 228. The left pivot unit 272 connects a left end portion of the first upper bail member 232 to the intermediate bail member 228.

The second upper bail member 236 of the frame apparatus 112 is pivotally connected to the intermediate bail member 228. The second upper bail member 236 includes a right pivot unit 276 and a left pivot unit 280. The right pivot unit 276 connects a right end portion of the second upper bail member 236 to the intermediate bail member 228. The left pivot unit 280 connects a left end portion of the second upper bail member 236 to the intermediate bail member 228.

The split bail member 240 of the frame apparatus 112 includes a right bail arm 284 and a left bail arm 288. The right bail arm 284 includes a pivot unit 292, which pivotally connects the right bail arm 284 to the second upper bail member 236. The left bail arm 288 includes a pivot unit 296, which pivotally connects the left bail arm 288 to the second upper bail member 236. A gap space 300 is provided between the right bail arm 284 and the left bail arm 288.

Figure 4:
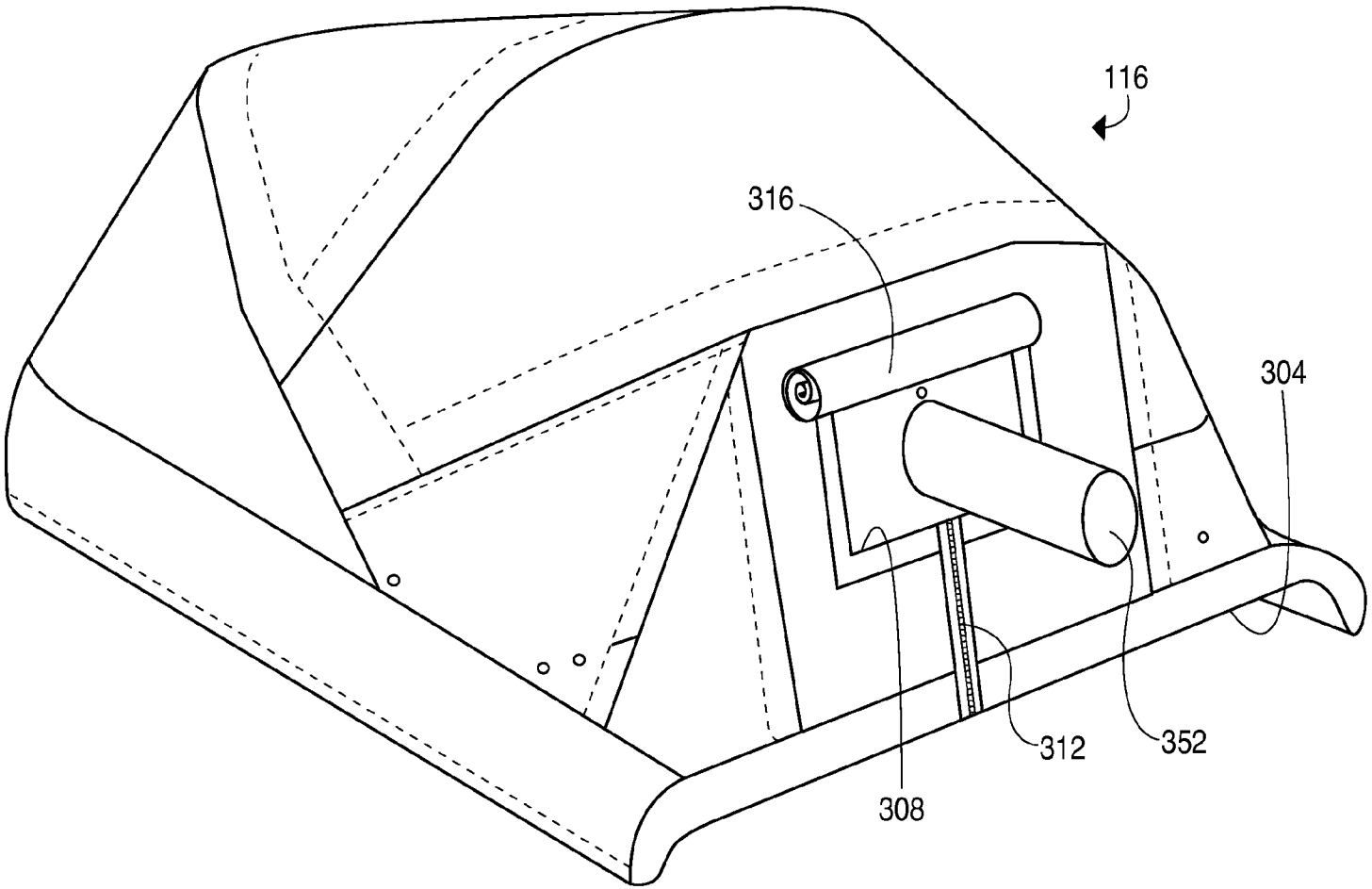
FIG. 4 shows a perspective view of a cover assembly of the cover apparatus of FIG. 1, the cover assembly is in the deployed position.

The canopy assembly 116 of the canopy apparatus 100, as shown in FIG. 4, is connected to and supported by the frame apparatus 112. The canopy assembly 116 is formed from a flexible material, such as canvas or the like. Specifically, the canopy assembly 116 may be formed from natural fibers, synthetic fibers, or a combination of natural and synthetic fibers. In one specific embodiment, the canopy assembly 116 is a 12-ounce weight canvas, which resists dust and dirt, and endures sun, rain, tension, wind stress, and snow loads. Additionally, the canopy assembly 116 may be water-repellant, and mildew and ultraviolet resistant. Still further, the canopy assembly 116 may be a camouflaged net structure (not shown).

As shown in FIGS. 1 and 4, the canopy assembly 116 defines a roof aperture 304 and a weapon aperture 308. The roof aperture 304 is configured to receive at least a portion of the vehicle 20, such as the roof portion 36, when the canopy apparatus 100 is in the deployed position (as shown in FIG. 1). A portion of the weapon system 24 is configured to extend through the weapon aperture 308 when the canopy apparatus 100 is in the deployed position (as shown in FIG. 1).

The canopy assembly 116 includes a closure apparatus 312 extending between the roof aperture 304 and the weapon aperture 308. When the closure apparatus 312 is in a closed position, as shown in FIGS. 1 and 4, the weapon aperture 308 is isolated from the roof aperture 304. When the closure apparatus 312 is in an open position (not shown) the weapon aperture 308 merges the roof aperture 304 to form a combined aperture. The closure apparatus 312 may be formed from a hook and loop closure system (i.e. Velcro), a zipper, or the like.

The canopy assembly 116 also includes a cover patch 316 that is movable between an open position and a closed position. In the open position, the weapon aperture 308 is unobstructed by the cover patch 316; however, in the closed position the cover patch closes the weapon aperture.

Although not illustrated in FIG. 4, the canopy assembly 116 may include air circulation vents to aid with heat dissipation and to reduce the potential for condensation to form on the underside of the deployed canopy assembly.

In operation, the canopy apparatus 100, is connectable to the vehicle 20 and is positionable to protect, shield, and/or cover equipment connected to the roof portion 36 of the vehicle 20. The canopy apparatus 100 is particularly effective at protecting and shielding the roof-mounted equipment from environmental elements such as rain, snow, sand, dust, and the like. The canopy apparatus 100 is also positionable to allow full operation of the roof-mounted equipment, such as the weapon system 24, and the vehicle 20 to which it is connected.

As shown in FIG. 5, the canopy apparatus 100 is easily connectable to the vehicle 20, according to the following process. First, track assemblies 104, 108 are connected to the roof portion 36 of the vehicle 20. To connect the right track assembly 104 to the roof portion 36, the rear hook member 124 is positioned to engage an existing rear ridge or opening 320 on the vehicle 20. Next, the clamp member 164 of the front hook member 128 is positioned in the open position. Subsequently, the roof hook 160 is positioned to engage an existing front ridge or opening 324 on the vehicle 20. Next, the clamp member 164 is positioned in the closed position to connect the right track assembly 104 to the vehicle 20. Webbed straps 328 may be provided (also shown in FIG. 2) to further secure the track assembly 104 to the roof portion 36 of the vehicle 20. The left track assembly 108 is connected to the vehicle 20 in an identical manner. Since the right track assembly 104 is identical to the left track assembly 108 a user may connect either assembly 104, 108 to either side of the vehicle 20, thereby further simplifying installation of the canopy apparatus 100.

The roof hook 160 and the rear hook member 124 engage existing ridges or openings 320, 324 present in the vehicle 20, such that a user may connect the canopy apparatus 100 to the vehicle without permanently modifying the vehicle in any way. For example, the Humvee vehicle 20 includes a roof portion 36 that is bordered by a series of existing ridges and openings. The track assemblies 104, 108 are structured to interface with these ridges and openings without bending, enlarging, or otherwise modifying the ridges and openings. Accordingly, the canopy apparatus 100 is useful in applications in which modification of the vehicle 20 is undesired or prohibited, such as in military applications in which the vehicle as a protective armor.

The connection process of the canopy apparatus 100 differs from the connection process of known vehicle covers, which use fastening members to connect to the vehicle. For example, these other vehicle covers may include brackets, which connect to the vehicle with screws, bolts, or other fastening members. The fastening members penetrate the vehicle surface and when removed leave behind bore holes in the vehicle. These permanent modifications (the bore holes) are undesirable and, in some applications, are prohibited.

Next the frame apparatus 112 and the canopy assembly 116 are connected to the track assemblies 104, 108 as a unit. First, the slide members 132, 204 are moved along the rail members 120, 192 toward the rear of the vehicle 20 to the position shown in FIG. 5. Second, the frame apparatus 112, which has the canopy assembly 116 connected thereto, is positioned on the rear hatch 332 of the vehicle 20. Third, the pivot units 244, 248 of the base bail member 224 are connected to the slide members 132, 204 with removable pins 172.

The canopy apparatus 100 is in the retracted position after the frame apparatus 112 and the canopy assembly 116 are connected to the track assemblies 104, 108, as described above. The canopy apparatus 100 can be stowed in the retracted position if covering of the roof-mounted equipment is not presently desired. The vehicle 20 and all of the equipment attached thereto may be operated normally with the canopy apparatus 100 in the retracted position. For example, the canopy apparatus 100 may be lifted to enable user access to the rear hatch 332 portion of the vehicle 20. The canopy apparatus 100 may include an additional cover member (not shown), which is configured to cover the frame apparatus 112 and the canopy assembly 116 when the canopy apparatus 100 is in the retracted position.

Figure 6:
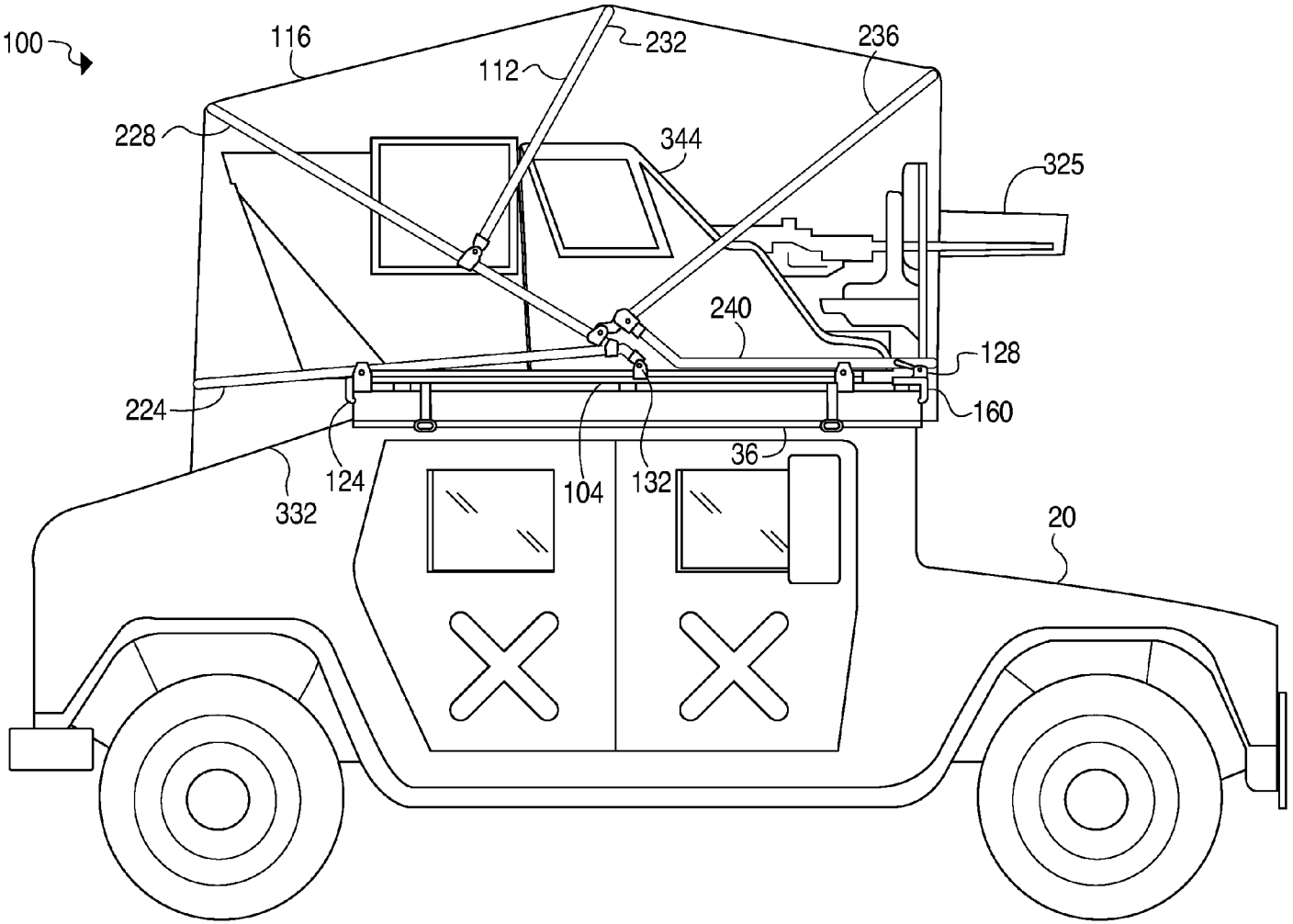
FIG. 6 shows a side elevational view, partially in cross-section, of the cover apparatus of FIG. 1 in the deployed position.
Figure 7:
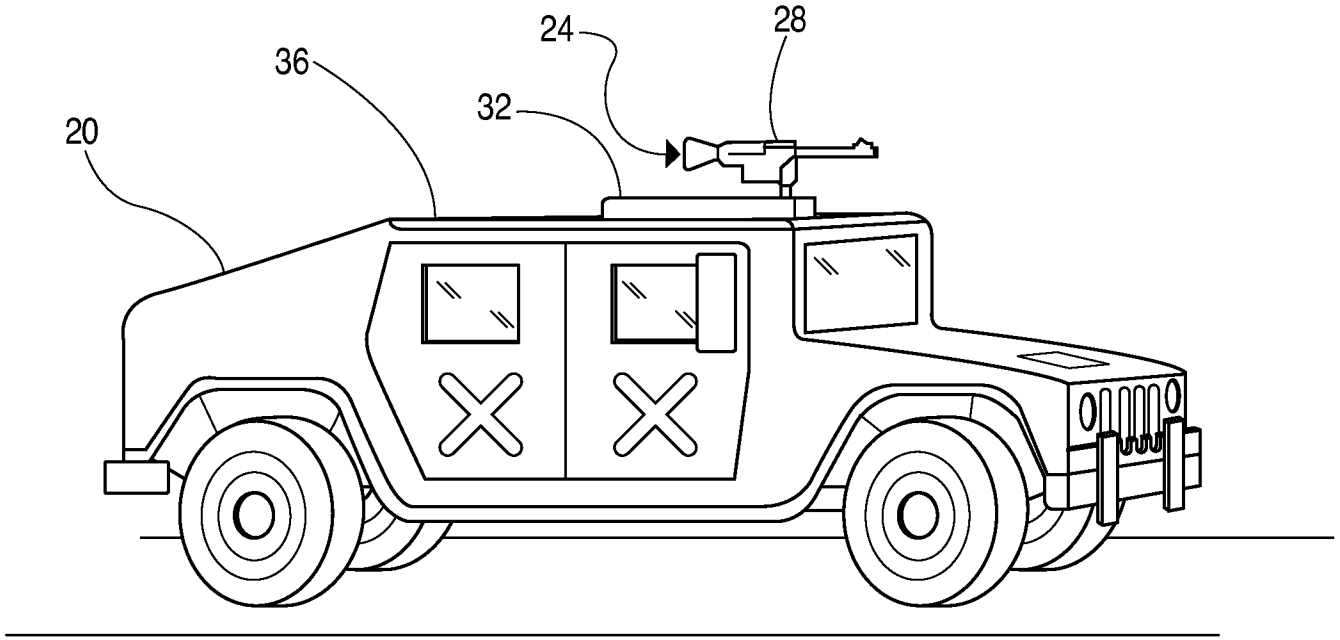
FIG. 7 shows a perspective view of a prior art vehicle having a roof-mounted weapon system, the vehicle and weapon system being suitable for use with the cover apparatus of FIG. 1.

As shown in FIG. 6, the canopy apparatus 100 may be unfurled from the retracted position to the deployed position, according to the following process. First, the frame apparatus 112 and the canopy assembly 116 are pushed, as a unit, toward the front of the vehicle 20 (in the direction 336 of FIG. 5), until the slide members 132, 204 abut the slide stops 136, 208. Second, the removable pins 172 are inserted through the openings in the fastening tabs 144, 216 to secure the base bail member 224 in a fixed position against the rail members 120, 192. Third, the split bail member 240 is moved along the pivot path 340 toward the front of the vehicle 20. The split bail member 240 is moved toward the front of the vehicle 20 until the bail arm 284 contacts the rail member 120 and the bail arm 288 contacts the rail member 192. Fourth, the removable pins 172 are inserted through the openings in the fastening tabs 140, 212 to secure in the spilt bail member 240 in a fixed position.

The vehicle 20 includes roof-mounted equipment 344 having a barrel portion 348 that extends beyond the region defined by the deployed canopy assembly 116. Accordingly, when unfurling the canopy apparatus 100 over the equipment 344, the closure apparatus 312 is opened to prevent the barrel portion 348 from limiting the movement of the split bail member 240, and to enable the barrel portion to pass through the gap space 300 defined by the split bail member 240 and into the weapon aperture 308. After the split bail member 240 is secured in a fixed position with the removable pins 172, the closure apparatus 312 may be moved to the closed position to isolate the weapon aperture 308 from the roof aperture 304. Additionally, a barrel cover 352 may be placed over the barrel portion 348 and secured to the canopy assembly 116.

The canopy apparatus 100 is easily positioned in the retracted position from the deployed position according to the following process. First, the removable pins 172 are removed from the fastening tabs 140, 212. Second, the closure apparatus 312 is opened, if necessary. Third, the split bail member 240 is moved to the rear of the vehicle 20 along the pivot path 356. At this point, the roof-mounted equipment 344 is uncovered and fully ready for use, but the canopy apparatus 100 is not fully in the retracted position. To position the canopy apparatus 100 in the fully retracted position, the removable pins 172 are removed from the fastening tabs 144, 216 and the frame apparatus 112 and the canopy assembly 116 are moved toward the rear hatch 332 of the vehicle as guided by the slide member 132, 204. The canopy apparatus 100 may then be stowed or the canopy apparatus may be completely removed from the vehicle 20 by removing the removable pins 172.

In another embodiment of the canopy apparatus 100, the track assemblies 104, 108 are different in structure, such that right track assembly 104 is connectable to only the right side of the vehicle 20 and the left track assembly 108 is connectable to only the left side of the vehicle. For example, one of the rail members 120, 192 may be curved or otherwise shaped differently than the other of the rail members to position one of the hook members 124, 128, 196, 200 to connect to an existing opening, ridge, or other feature that is not directly in line with the one rail member.

In yet another embodiment of the canopy apparatus 100, the track assemblies 104, 108 are adjustable so as to be connectable to different types of vehicles 20. In this embodiment, one or more of the rear hook member 124, 200 and the front hook member 128, 196 are movable along the rail member 120, 192 in a direction parallel to the longitudinal axis 152. Thus, the distance between the rear hook member 124, 200 and the front hook member 128, 196 is adjustable to conform to the length of the portion of the vehicle 20 to which the track assembly 104, 108 is to be connected.

The device described herein has been illustrated and described in detail in the figures and foregoing description, the same should be considered as illustrative and not restrictive in character. It should be understood that only the preferred embodiments have been presented and that all changes, modifications, and further applications that come within the spirit of the device described herein are desired to be protected.

What is claimed is:

1. A canopy apparatus configured for connection to a roof portion of a vehicle, comprising:

a first track assembly including (i) a first rail member, (ii) a first hook member connected to a first end portion of the first rail member, (iii) a second hook member connected to a second end portion of the first rail member, and (iv) a first slide member configured for movement along the first rail member between the first and the second hook members;

a second track assembly including (i) a second rail member, (ii) a third hook member connected to a third end portion of the second rail member, (iii) a fourth hook member connected to a fourth end portion of the second rail member, and (iv) a second slide member configured for movement along the second rail member between the third and the fourth hook members;

a frame apparatus including (i) a first bail member having a fifth end portion pivotally connected to the first slide member and a sixth end portion pivotally connected to the second slide member, (ii) a second bail member pivotally connected to the first bail member, (iii) a third bail member pivotally connected to the second bail member, and (iv) a split bail member including a first bail arm pivotally connected to the third bail member and a second bail arm pivotally connected to the third bail member; and a canopy assembly configured for connection to at least one of the first, second, and third bail members, wherein the first and the second hook members are configured to connect the first rail member to the roof portion of the vehicle without modifying the roof portion, wherein the third and the fourth hook members are configured to connect the second rail member to the roof portion of the vehicle without modifying the roof portion, and wherein the frame apparatus is movable relative to the first and the second track assembly between a deployed position and a retracted position.

2. The canopy apparatus of claim 1, wherein:

the split bail member defines a gap space between a seventh end portion of the first bail arm and an eighth end portion of the second bail arm.

3. The canopy apparatus of claim 2, wherein the canopy assembly defines an aperture.

4. The canopy apparatus of claim 3, wherein:

the first rail member defines a longitudinal axis, and the frame apparatus is movable relative to the first and the second rail members in a direction parallel to the longitudinal axis about the first and the second slide assemblies.

5. The canopy apparatus of claim 4, further comprising:

a first slide stop connected to the first rail member;

a second slide stop connected to the second rail member, wherein the first slide member is configured to slide about the first rail member between the first hook member and the first slide stop, and wherein the second slide member is configured to slide about the second rail member between the third hook member and the second slide stop.

6. The canopy apparatus of claim 2, wherein:

the first track assembly includes a first fastening tab configured to receive a first removable pin, the second track assembly includes a second fastening tab configured to receive a second removable pin, a first hold down portion of the first bail arm is configured to be positioned between the first rail member and the first removable pin, and a second hold down portion of the second bail arm is configured to be positioned between the second rail member and the second removable pin.

7. The canopy apparatus of claim 1, wherein the fifth end portion of the first bail member is connected to the first slide assembly with a first removable pin and the sixth end portion of the first bail member is connected to the second slide member with a second removable pin, such that the frame member is removable from the first and the second track assemblies by removal of the first and the second removable pins.

8. The canopy apparatus of claim 1, wherein the canopy apparatus is connected to the roof portion of the vehicle, the vehicle including a roof-mounted weapon system, and wherein the canopy assembly covers at least a first portion of the roof-mounted weapon system when the frame apparatus is in the deployed position.

9. The canopy apparatus of claim 8, wherein:

the split bail member defines a gap space between a seventh end portion of the first bail arm and an eighth end portion of the second bail arm, and a second portion of the roof-mounted weapon system passes through the gap space when the frame apparatus moves from the deployed position to the retracted position.

10. The canopy apparatus of claim 9, wherein the canopy assembly defines an aperture and the second portion of the roof-mounted weapon system extends through the aperture when the frame apparatus is in the deployed position.

11. A canopy apparatus configured for connection to a vehicle, comprising:

a first and a second track assembly configured for connection to the vehicle, the first track assembly defining a longitudinal axis;

a first slide member slideably engaging the first track assembly and configured to move relative to the first track assembly in a direction parallel to the longitudinal axis;

a second slide member slideably engaging the second track assembly and configured to move relative to the second track assembly in the direction parallel to the longitudinal axis;

a frame apparatus including (i) a first bail member having a first end portion configured for pivotal connection to the first slide member and a second end portion configured for pivotal connection to the second slide member, (ii) a second bail member pivotally connected to the first bail member, (iii) a third bail member pivotally connected to the second bail member, and (iv) a split bail member including a first bail arm pivotally connected to the third bail member and a second bail arm pivotally connected to the third bail member; and a canopy assembly configured for connection to the frame apparatus, wherein the frame apparatus is configured for movement in the direction parallel to the longitudinal axis about the first and the second track assemblies.

12. The canopy apparatus of claim 11, wherein the frame apparatus is further configured for movement to position the canopy assembly in one of a furled position and an unfurled position.

13. The canopy apparatus of claim 12, wherein the first and the second track assemblies are configured for connection to a roof portion of the vehicle.

14. The canopy apparatus of claim 13, wherein the vehicle includes a roof-mounted weapon system connected to the roof portion of the vehicle, wherein the canopy assembly covers at least a portion of the roof-mounted weapon system connected to the roof portion of the vehicle when the canopy assembly is in the unfurled position.

15. The canopy apparatus of claim 11, wherein the first and the second track assemblies are configured for connection to the vehicle without modifying the vehicle.

16. The canopy apparatus of claim 11, wherein:

the first track assembly includes a debris outlet, and the debris outlet is configured to enable debris in the first track assembly to exit the first track assembly.

* * * * *